United States Patent [19]

Franchy et al.

[11] Patent Number: 4,584,474

[45] Date of Patent: Apr. 22, 1986

[54] ELECTRON ENERGY ANALYZER WITH MULTI-CHANNEL DETECTOR

[75] Inventors: René Franchy, Julich; Harald Ibach, Aachen-Verlautenheide; Heinz D. Bruchmann, Aldenhoven-Durbosland, all of Fed. Rep. of Germany

[73] Assignee: KFA Julich, Fed. Rep. of Germany

[21] Appl. No.: 592,691

[22] Filed: Mar. 23, 1984

[30] Foreign Application Priority Data

Mar. 26, 1983 [DE] Fed. Rep. of Germany ..... 3311195

[51] Int. Cl.[4] ..... H01J 40/00; H01J 47/00

[52] U.S. Cl. ..... 250/305; 250/505.1

[58] Field of Search ..... 250/305, 263, 284, 505.1; 313/103 CM, 105 CM

[56] References Cited

U.S. PATENT DOCUMENTS 3,806,728 4/1974 Lindholm et al. ..... 250/305

4,128,763 12/1978 Polaschegg ..... 250/305

OTHER PUBLICATIONS

J. L. Wize, Nuclear Instruments and Methods, "Microchannel Plate Detectors", vol. 162, (1979), 567.

*Primary Examiner*—Bruce C. Anderson

*Attorney, Agent, or Firm*—Scully, Scott, Murphy & Presser

[57] ABSTRACT

An electron energy analyzer in which electrons arriving through an entrance aperture in an energy-dispersive system, are simultaneously analyzed at the exit of the system through a multi-channel detector operating with channel plates. The electron energy analyzer is distinguished through a grid at the exit of the analyzer which is to be brought to the potential of the entrance aperture plate, at the smallest possible spacing from the channel plate or plates, whose mesh size dimension is so small in comparison with the dimension of the electron beam, that no additional structure will be obtained in the registered electron spectrum because of the grid, with a blending grid mask whose blending conforms with the beam dimension and the spacing of the electrodes in the analyzer, and which is brought to a potential with respect to the channel plate, which is adequate for the aspiration of the electrons strayed from the facing channel plate.

5 Claims, 6 Drawing Figures

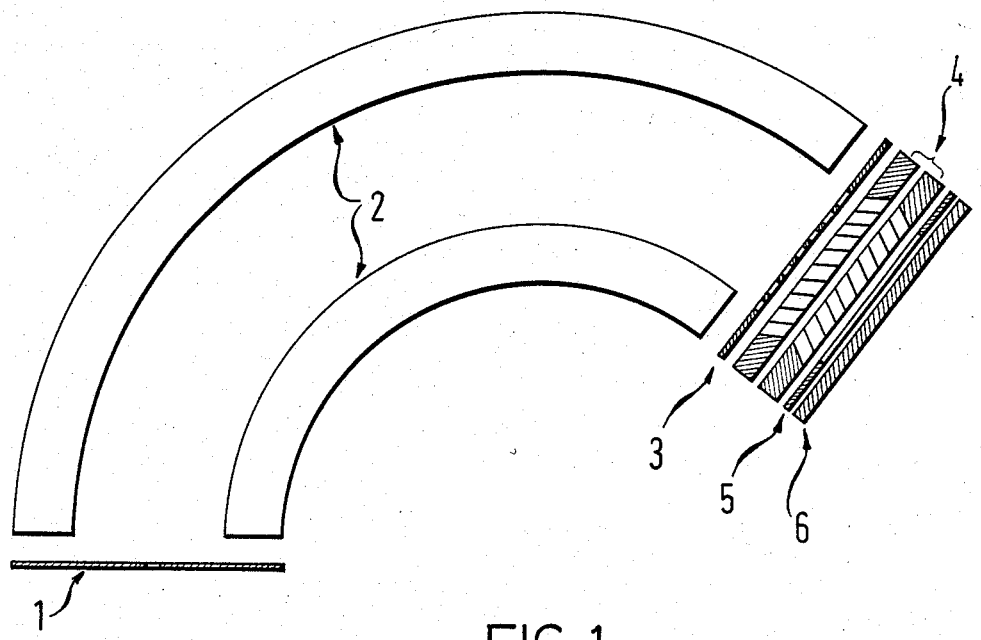
FIG. 1
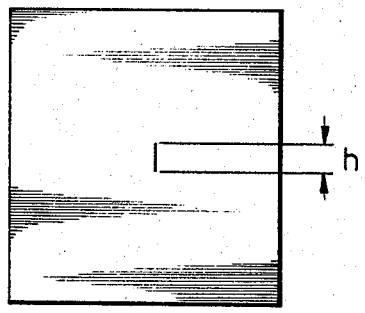

ELECTRON ENERGY ANALYZER WITH MULTI-CHANNEL DETECTOR

BACKGROUND OF THE INVENTION

1. Field of the Invention

The present invention relates to an electron energy analyzer in which electrons arriving through an entrance aperture in an energy-dispersive system, are simultaneously analyzed at the outlet of the system through a multi-channel detector operating with channel plates.

2. Discussion of the Prior Art

Electron energy analyzers are, in particular, employed in combination with a suitable electron monochromator as electron spectrometers for the analysis of gases and the surfaces of solids, as well as for the investigation of the vibration spectra of adsorbed substances, and are thereby employed in catalyst research (referring to H. Ibach, D. L. Mills "Electron Energy Loss Spectroscopy and Surface Vibrations", Acad. Press, New York 1982).

In such an electron energy analyzer, the electrons traverse different paths, in abcordance with their energy, and arrive at positions on a multi-channel detector (referring to J. L. Wiza "Nucl. Instr. and Meth." 162 (1979) 567) which are correlated with their energy. Thereafter when effecting a position sensitive analysis, there is obtained a part spectrum (or total spectrum) of the electrons.

Any multi-channel detection in electron energy loss-spectroscopy hypothesizes that there is afforded a lower background, inasmuch as the electron energy loss signals which are to be measured are lower by a few magnitudes than are the electron signals which arrive at the detector without any energy loss (elastically reflected).

The arrangement of an analyzer with channel plate or plates at its outlet which for this reason, it connected ahead of the actual detector element, as known, is still not completely satisfying.

SUMMARY OF THE INVENTION

Accordingly, it is an object of the present invention to provide an electron energy analyzer with a multi-channel detector with the lowest possible background.

The foregoing object is achieved, pursuant to the invention, through the intermediary of an electron energy analyzer of the above-mentioned type, which is distinguished through a grid at the outlet of the analyzer which is to be brought to the potential of the entrance aperture plate, at the smallest possible spacing from the channel plate or plates, whose mesh size dimension is so small in comparison with the dimension of the electron beam, that no additional structure will be obtained in the registered electron spectrum because of the grid, with a grid mask whose aperture conforms with the beam dimension and the spacing of the electrodes in the analyzer, the facing channel plate surface being negatively biased with respect to the grid mask in order to aspirate the electrons strayed from the facing channel plate surface.

Through such a multi-channel detection, there can be improved the sensitivity of an electron impact spectrometer by about two magnitudes.

The effective reduction of the background is essentially achieved by means of the following effects:

1. Stray electrons which impact against the portion of the grid mask which is impermeable to the electrons (whose aperture corresponds with the height of the electron beam which is to be measured and the distance between the electrodes), are kept away from the channel plate.

2. Stray electrons which are produced through the impact of the electrons against the channel plate, are aspirated through the grid which is at a suitable potential with respect to the facing surface of the channel plate.

3. Stray electrons which can be produced during electron impact on the mask and grid, are preferably reduced through a coating of the mask-grid system with a substance having low secondary electron emission coefficients.

4. The dark count rate of the channel plates can be reduced through the interpositioning of an aperture mask between the channel plate or plates and a resistance plate, and namely by a factor which corresponds with the ratio of the surface of the aperture relative to the active total surface of the channel plate.

DESCRIPTION OF THE DRAWINGS

Reference may now be had to the following detailed description of an exemplary embodiment of the invention elucidating further inventive features, taken in conjunction with the accompanying drawings; in which:

FIG. 1 schematically illustrates an electron energy analyzer with the inventive detector arrangement shown in both plan and front elevational views;

DETAILED DESCRIPTION

Figure 2A:
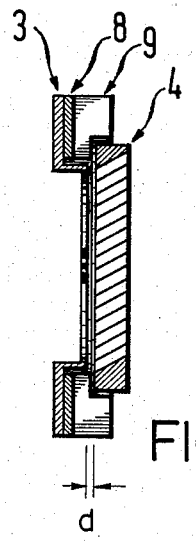
FIG. 2*a–b* illustrates, respectively, front and side views of the grid and the grid mask.

A typical embodiment of an electron energy analyzer with a multi-channel detector and a low background is illustrated in FIG. 1 of the drawings. The electrons which are reflected from a sample are analyzed with regard to their energy in an energy-dispersive analyzer (127°-cylinder, hemispherical, or cylindrical-mirror, plate-mirror analyzer). In the embodiment of FIG. 1 there is illustrated a 127°-cylinder analyzer. The electrons which approach from the entrance aperture (entrance aperture plate 1) are deflected with the aid of the electrodes 2 of the energy analyzer, and pass through the grid 3 in the channel plate system 4 (constructed as a tandem channel plate) and finally through the mask 5 onto the resistance plate 6 (in lieu of the tandem channel plates there can also be provided, for example, a single-step curved channel plate). With the aid of the resistance plate 6 there is determined, in a suitably selected type and manner (for example, rise time encoding technique or charge distribution measurement), the position of the electrons which strike against the channel plate.

Figure 2B:
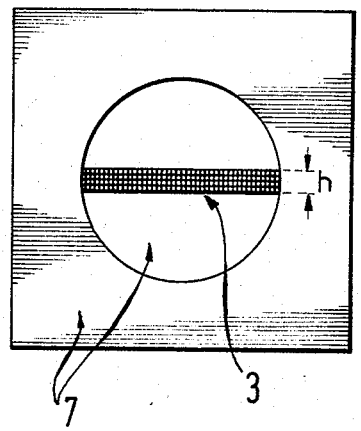

The entrance aperture of plate 1 has the height h, which determines the height of the electron beam which is to be measured, and which falls onto the detector after passing through the analyzer. Stray electrons can, however, impact against the channel plate above or below the position corresponding to the height (h), and thereby produce a background. The mask 7 of the grid 3 (referring to FIGS. 2*a* and 2*b*) ahead of the channel plate 4 will thereby prevent that the stray electrons which do not conform with the desired configuration of the entrance aperture, will arrive on the channel plate. In essence, the stray electrons cannot pass through the impermeable, coated portion (see FIG. 2*b*).

The grid is preferably coated with a substance having low electron emission coefficients (for example, graphite) in order to reduce the backstraying of electrons.

The electrons within in the beam height (h) which are to be measured pass through the grid and are identified in the detector. Upon striking of the electrons against the channel plate or plates, besides the desired effect of the electron multiplication there are produced stray electrons reflected by the channel plate (distributed over the entire channel plate) which increase the background. The insulated fastening (insulator 8 over the mounting 9 for the channel plates 4) of the grid (with grid mask), allows for the application of a voltage between the grid and the channel plate so that the stray electrons can be aspirated. The smaller the spacing "d" (refer to FIG. 2*a*), the greater the reduction of the background.

The entrance and exit of the electron energy analyzer should be at the same potential. When a channel plate is located at the exit of the analyzer, then because of the work function of the channel plate and because of the penetration of the supply voltage through the channel plates, there must be provided a correction of the facing surface of the channel plate potential. The grid, which is coated with the same substance as the entrance aperture plate 1 of the analyzer pursuant to FIG. 1, thereby facilitates the utilization of different channel plates without the necessity for compensating for their work function.

The channel plates typically have a thickness of 0.5 mm and require a supply voltage of about 1000 volts for electron multiplication. At this supply voltage, a passing through of the voltage in the region of the analyzer would be unavoidable, which would also lead to a difference between the input and output potentials of the analyzer. The grid system 3, 7 which is at a suitable potential located ahead of the channel plate 4, prevents the penetration of the channel plate voltage into the analyzer space.

Figure 3A:
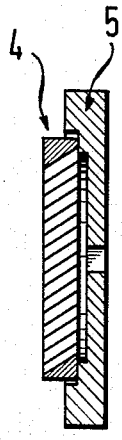
FIG. 3*a–b* llustrates, respectively, front and side views of the aperture mask.
Figure 3B:
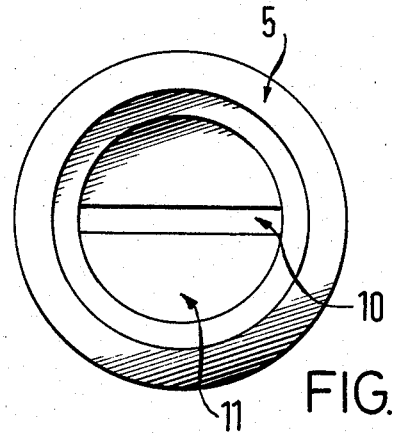

The channel plates typically have a dark count rate of 1 pulse/cm$^2$ sec. At an active diameter of the channel plates of 25 mm, this signifies a dark count rate of about 5 pulses/sec. The aperture mask 5 (with the aperture 10 and the impermeable portion 11, referring to FIGS. 3*a* and 3*b*) between the output of the channel plate 4 and the resistance plate 6, reduces the dark count rate by a factor which corresponds to the ratio of the aperture surface relative to the active total surface of the channel plate.

Figure 4:
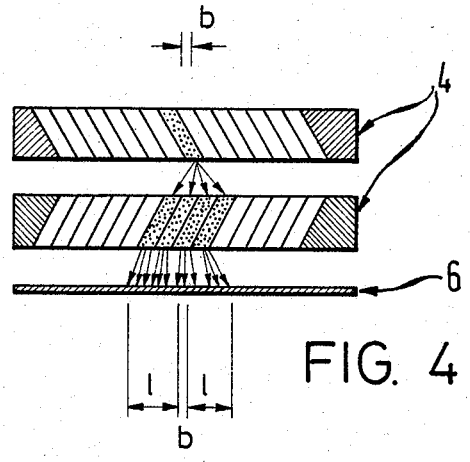
FIG. 4 is a schematic representation elucidating the diffusion spread.

The length of the aperture corresponds to the spacing between the two electrodes 2 of the electron energy analyzer as shown in FIG. 1. The height of the aperture corresponds to the height "h" of the utilized electron beam plus twice the diffusion spread (approximately 0.5 mm) by the channel plates and resistance plate arrangement. To be understood under the concept diffusion spread "1", is the widening which an electron beam having the width "b" will encounter upon passage through the channel plates up to striking against the resistance plate (referring to FIG. 4).

With a 127°-cylinder analyzer, which employs an electron beam having the height 2 mm and which has an electrode spacing of 25 mm, there is obtained a reduction in the dark count rate by a factor of 10.

In order to maintain the spacing as small as possible between the exit of the channel plate and the resistance plate, so that there is realized a high positional resolution, the aperture mask 5 is employed for the support of the second channel plate 4.

Investigations have indicated that, by means of the inventive measures, the background is significantly reduced.

What is claimed is:

1. In an electron energy analyzer having an entrance aperture wherein electrons received in the energy-dispersive system are simultaneously analyzed at the exit thereof through a multi-channel detector operating with channel plates; the improvement comprising: a grid which is to be brought to the potential of the entrance aperture plate being arranged at the exit of the analyzer at a minimum distance from said channel plate or plates, said grid having mesh width dimensions in the range between 10 and 100 μm, said mesh width being small in comparison with the dimension of the electron beam so that no additional structure is provided in the registered electron spectrum due to the grid; a grid mask whose aperture conforms with the beam dimension and the spacing between electrodes in the analyzer, the surface of the channel plate facing said grid mask being negatively biased with respect to said grid mask for aspirating electrons straying from the facing channel plate surface through the grid.

2. Electron energy analyzer as claimed in claim 1, wherein the potential of the grid relative to the channel plate surface lies at between 0 and 2 volts dependent upon the pass energy of the analyzer.

3. Electron energy analyzer as claimed in claim 1, wherein said grid and said mask are coated with a substance having low secondary electron emission coefficients.

4. Electron energy analyzer as claimed in claim 1, comprising a detector having a resistance plate located at the exit of the channel plate, and an aperture mask between the resistance plate and the channel plate, wherein the aperture conforms to the exposed surface of the grid mask.

5. Electron energy analyzer as claimed in claim 1, wherein said grid has a thickness of less than 0.5 mm, and in particular a thickness of between 10 to 100 μm.

* * * * *